US012716138B2

(12) United States Patent
Lang et al.

(10) Patent No.: US 12,716,138 B2
(45) Date of Patent: Aug. 25, 2026

(54) MULTIPHASE HETEROJUNCTION NANOMATERIAL, PREPARATION METHOD AND USE THEREOF

(71) Applicant: SOOCHOW UNIVERSITY, Suzhou (CN)

(72) Inventors: Jianping Lang, Suzhou (CN); Jiangyan Xue, Suzhou (CN); Chunyuan Ni, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 1016 days.

(21) Appl. No.: 17/911,645

(22) PCT Filed: Dec. 30, 2021

(86) PCT No.: PCT/CN2021/143125
§ 371 (c)(1),
(2) Date: May 19, 2023

(87) PCT Pub. No.: WO2023/082449
PCT Pub. Date: May 19, 2023

(65) Prior Publication Data

US 2024/0209527 A1 Jun. 27, 2024

(30) Foreign Application Priority Data

Nov. 11, 2021 (CN) ..... 202111334639.X

(51) Int. Cl.
*C25B 11/091* (2021.01)
*C25B 1/04* (2021.01)
(Continued)

(52) U.S. Cl.
CPC ..... *C25B 11/091* (2021.01); *C25B 1/04* (2013.01); *C25B 11/031* (2021.01); *C25B 11/052* (2021.01); *C25B 11/061* (2021.01)

(58) Field of Classification Search
CPC ... C25B 11/091; C25B 11/061; C25B 11/031; C25B 11/052; C25B 1/04
See application file for complete search history.

(56) References Cited

FOREIGN PATENT DOCUMENTS

CN 107051550 A 8/2017
CN 111495395 A 8/2020
(Continued)

OTHER PUBLICATIONS

Zhiyu Zhang et al., "Core/shell-structured NiMoO4 @ MoSe2/NixSey Nanorod on Ni Foam as a Bifunctional Electrocatalyst for Efficient Overall Water Splitting" Colloids and Surfaces A, 599 (2020) 124888 (Apr. 25, 2020).
(Continued)

*Primary Examiner* — James A Fiorito
(74) *Attorney, Agent, or Firm* — SZDC Law PC

(57) ABSTRACT

The present invention relates to the technical field of nanomaterials, and specifically provides a method for preparing multiphase heterojunction nanomaterials. The method comprises the following steps: providing a substrate loaded with a $NiMoO_4$ precursor; dissolving a selenium powder in hydrazine hydrate, adding water or sodium molybdate aqueous solution, then adding the substrate loaded with a $NiMoO_4$ precursor, and reacting at 180-200° C.; and after the reaction, obtaining the multiphase heterojunction nanomaterials. The present invention also provides a tetraphase heterojunction nanomaterial 1T/2H-$MoSe_2$—H/R—NiSe, and a triphase heterojunction nanomaterial 1T/2H-$MoSe_2$—H—NiSe prepared by the method, and use thereof as an electrocatalyst to catalyze a hydrogen evolution reaction under an alkaline condition. The multiphase heterojunction nanomaterials prepared in the present invention possess large double-layer capacitance, large electrochemical active specific area and low charge transfer resistance, thus greatly
(Continued)

improving the activity and stability of electrocatalytic hydrogen production.

7 Claims, 9 Drawing Sheets

(51) Int. Cl.
*C25B 11/031* (2021.01)
*C25B 11/052* (2021.01)
*C25B 11/061* (2021.01)

(56) References Cited

FOREIGN PATENT DOCUMENTS

| | | | |
|---|---|---|---|
| CN | 112725826 | A | 4/2021 |
| CN | 113089014 | A | 7/2021 |
| CN | 113249751 | A | 8/2021 |
| CN | 113604838 | A | 11/2021 |

OTHER PUBLICATIONS

Long Zhang et al., "Hydrothermal Synthesis of 3D Hierarchical MoSe2/NiSe2 Composite Nanowires on Carbon Fiber Paper and Enhanced Electrocatalytic Activity for Hydrogen Evolution Reaction" Journal of Materials Chemistry A, vol. 37, No. 5, pp. 19752-19759 (Aug. 23, 2017).
Zhiyu Zhang, "Performance and preparation of nickel form-based selenide and nitride as a bifunctional photo-electrocatalyst for efficient overall water splitting" Master's Thesis, Beijing University Chemical Technology (Feb. 15, 2021).

MULTIPHASE HETEROJUNCTION NANOMATERIAL, PREPARATION METHOD AND USE THEREOF

This application is the National Stage Application of PCT/CN2021/143125, filed on Dec. 30, 2021, which claims priority to Chinese Patent Application No. 202111334639.X, filed on Nov. 11, 2021, which is incorporated by reference for all purposes as if fully set forth herein.

FIELD OF THE INVENTION

The present invention relates to the field of nano-material preparation technologies, and specifically to a multiphase heterojunction nanomaterial, preparation method and use thereof.

DESCRIPTION OF THE RELATED ART

Hydrogen produced by water electrolysis is considered to be one of the most promising clean energy carriers due to its high energy density, carbon-free nature, and practicality in transportation and distribution (F. Podjaski, D. Weber, S. Zhang, L. Diehl, R. Eger, V. Duppel, E. Alarcón-Lladó, G. Richter, F. Haase, A. Morral, C. Scheu and B. V. Lotsch, Nat. Catal., 2020, 3, 55-63). Commercial noble metal-based catalysts possess low overpotential, low Tafel slope, and high current density in hydrogen evolution reaction (HER) but suffers from serious bottleneck problems such as scarcity, high cost, and instability. Therefore, the development of less expensive, highly efficient and much accessible electrocatalysts for HER is a focus research field in the future.

Transition-metal chalcogenides have been explored as one of the key alternatives to noble metal catalysts toward HER owing to their intrinsic advantages such as high activity, low cost and environmental friendliness. As a typical HER-active transition-metal dichalcogenide, molybdenum diselenide ($MoSe_2$) has attracted widespread research attention due to adjustable crystal structure and electronic structure, remarkable activity and stability. Studies show that the HER performance of $MoSe_2$ is greatly affected by its phases (1T/2H). 1T-$MoSe_2$ owns higher catalytic activity, but it is thermodynamically unstable and is relatively easy to convert to 2H phase with lower electronic conductivity and catalytic activity. Besides, the electronic transport capacity of a single-component phase is generally poor, and the catalytic properties are easy to touch the ceiling. These problems can be effectively solved by constructing a multiphase heterojunction nanomaterial. The resulting heterojunctions can compensate for the shortcomings each another, and cause synergistic effects into a single entity, thereby optimizing the inherent active species, active site and conductivity of electrocatalysts, and promoting the HER performance that occurs on the surface or interfaces of catalysts (R. Subbaraman, D. Tripkovic, D. Strmcnik, K.-C. Chang, M. Uchimura, A. P. Paulikas, V. Stamenkovic and N. M. Markovic, Science, 2011, 334, 1256). Hu et al. reported the successful preparation of 1T-$MoSe_2$/NiSe heterostructure nanowire arrays for synergistically enhanced HER with high intrinsic activity for water dissociation and $H_2$ formation. More importantly, the electronic injection from NiSe to $MoSe_2$ induced the phase transition from 2H—$MoSe_2$ to 1T-$MoSe_2$, and presented good electrocatalytic activity with a low overpotential of 200 mV at a current density of 50 mA $cm^{-2}$ (X. Zhang, Y. Y. Zhang, Y. Zhang, W. J. Jiang, Q. H. Zhang, Y. G. Yang, L. Gu, J. S. Hu and L. J. Wan, Small Methods, 2019, 3, 1800317).

Most of the current studied heterojunction nanomaterials is limited to two phases. The precise control of heterostructure combined with three or more phases is rarely explored. There remains some underlying problems, such as whether the performance of a heterojunction material becomes better and better with the increase of the number of phases? Therefore, optimizing the structure of heterojunction through phase modulation synergistic with interface engineering and constructing a $MoSe_2$-based heterojunction catalyst (>two-phase) with high activity and high stability is of great significance in the field of electrocatalysis, which can pave a new approach for the rational design and utilization of heterojunction materials with more than two phases.

SUMMARY OF THE INVENTION

In view of the above technical problems, the present invention provides a method for preparing multiphase heterojunction nanomaterials, with a tetraphase 1T/2H—$MoSe_2$—H/R—NiSe and a triphase 1T/2H—$MoSe_2$—H—NiSe. Such synthesis method is simple and the resulted multiphase heterojunction nanomaterials possess large double-layer capacitance, large electrochemical active specific area and low charge transfer resistance, thus greatly improving the activity and stability of electrocatalytic hydrogen production.

To solve the above technical problems, the present invention provides a method for preparing a multiphase heterojunction nanomaterial, which comprises the following steps:

providing a substrate loaded with a $NiMoO_4$ precursor; dissolving a selenium powder in hydrazine hydrate, adding water or sodium molybdate aqueous solution, then adding the substrate loaded with a $NiMoO_4$ precursor, and reacting at 180-200° C.; and after the reaction, obtaining the multiphase heterojunction nanomaterial.

When water is added to hydrazine hydrate, the obtained product is a tetraphase heterojunction nanomaterial 1T/2H—$MoSe_2$—H/R—NiSe; and when sodium molybdate aqueous solution is added to hydrazine hydrate, the obtained product is a triphase heterojunction nanomaterial 1T/2H—$MoSe_2$—H—NiSe, where $MoSe_2$ represents molybdenum diselenide, NiSe represents nickel selenide, 1T represents the Trigonal phase $MoSe_2$, 2H represents the Hexagonal phase $MoSe_2$, H represents the Hexagonal phase NiSe, and R represents the Rhombohedral phase NiSe.

In the present invention, various multiphase heterojunction nanomaterials are obtained through interface engineering using $NiMoO_4$—NF as a sacrificial template. The operation is simple and can realize element doping and structure optimization at the same time to obtain rare tetraphase and triphase products. There is no need to introduce a surfactant for morphology modification during the preparation process. The product is easy to clean and can be directly used as a self-supporting electrode for HER which is convenient and efficient.

In the present invention, $NiMoO_4$ nanorods are grown on a substrate by hydrothermal method, where the substrate is preferably nickel foam (NF). Preferably, $NiMoO_4$ is synthesized through a process comprising dissolving nickel nitrate and sodium molybdate in deionized water, adding the substrate, and reacting at 150° C. for 6 h, to obtain $NiMoO_4$ nanorods.

Preferably, the volume ratio of hydrazine hydrate to water is 1-2: 8-9, and more preferably 1.6:8.4.

Preferably, the molar ratio of the selenium powder to sodium molybdate is 2:0.5-1, and more preferably 2:1.

Preferably, the reaction temperature is 200° C.

Preferably, and the reaction time is 2-6 h.

Preferably, the method further comprises a step of washing and drying the obtained product. Still further, the solvent for washing is deionized water and absolute ethanol.

Preferably, the washed product is dried in a blast drying oven. Preferably, the drying temperature is 40-60° C., and the drying time is 2-12 h. Further preferably, the drying temperature is 60° C., and the drying time is 12 h.

On the other hand, the present invention provides a tetraphase heterojunction nanomaterial 1T/2H—$MoSe_2$—H/R—NiSe and a triphase heterojunction nanomaterial 1T/2H—$MoSe_2$—H—NiSe prepared by the method.

The present invention provides use of the tetraphase 1T/2H—$MoSe_2$—H/R—NiSe and the triphase 1T/2H—$MoSe_2$—H—NiSe as an electrocatalyst toward HER under an alkaline condition.

The present invention has the following beneficial effects.

1. In the present invention, $NiMoO_4$ nanorods are formed on a substrate by hydrothermal method, which is then used as a sacrificial template in hydrothermal reaction to obtain triphase 1T/2H—$MoSe_2$—H—NiSe nanosheets and tetraphase 1T/2H—$MoSe_2$—H/R—NiSe nanorods. The synthesis method is simple and easy to operate, and can realize the construction and structure optimization of complex heterojunctions at the same time.

2. The triphase 1T/2H—$MoSe_2$—H—NiSe nanosheets and tetraphase 1T/2H—$MoSe_2$—H/R—NiSe nanorods prepared in the present invention have large double-layer capacitance, large electrochemical active specific area, and low charge transfer resistance, thus greatly improving the activity and stability toward HER.

3. In the present invention, a conductive substrate nickel foam is introduced during the preparation process, which can be directly used as a self-supporting electrode, and is easy to operate.

4. The material prepared in the present invention is a low-cost non-noble metal-based catalyst.

5. The 1T/2H—$MoSe_2$—H/R—NiSe nanorods prepared in the present invention shows excellent HER activity in an alkaline electrolyte (pH=14), with an overpotential of 87.6 mV at a current density of 10 $mA \cdot cm^{-2}$, and the Tafel slope is as low as 139.5 $mV \cdot dec^{-1}$.

6. The 1T/2H—$MoSe_2$—H—NiSe nanosheets prepared in the present invention exhibits remarkably enhanced HER activity in an alkaline electrolyte (pH=14), with an overpotential of 30.6 mV at 10 $mA \cdot cm^{-2}$, Tafel slope of 132.2 $mV \cdot dec^{-1}$ and a negligible voltage change even when operated for 40 h.

DETAILED DESCRIPTION OF THE PREFERRED EMBODIMENTS

The present invention will be further described below with reference to the accompanying drawings and specific examples, so that those skilled in the art can better understand and implement the present invention; however, the present invention is not limited thereto.

Unless otherwise defined, all technical and scientific terms used herein have the same meaning as commonly understood by persons skilled in the art to which the present invention pertains. The terms used in the descriptions of the present invention are for the purpose of describing specific embodiments only and are not intended to limit the present invention. The term "and/or" as used herein includes any and all combinations of one or more of the listed related items.

Example 1: Preparation of 1T/2H—$MoSe_2$—H/R—NiSe 0.5 mmol nickel nitrate and 0.5 mmol sodium molybdate were mixed in 15 mL deionized water, and then transferred into a Teflon-lined stainless-steel autoclave and NF (2 cm*2 cm) was added. The autoclave was sealed and maintained at 150° C. for 6 h. After the reaction, it was naturally cooled down to room temperature, and the resulting product was washed with deionized water and ethanol, and dried at 60° C. to obtain the precursor $NiMoO_4$—NF. The dried $NiMoO_4$—NF was calcined at 450° C. for 2 h under argon atmosphere to obtain crystallized $NiMoO_4$ nanostructures. ⅔ mmol selenium powder was dissolved in 1.6 mL hydrazine hydrate solution, and then 8.4 mL deionized water was added. The solution was transferred into a Teflon-lined stainless-steel autoclave and $NiMoO_4$—NF was added. The autoclave was sealed and maintained at 200° C. for 2 h. After the reaction, it was naturally cooled down to room temperature, the product was washed with deionized water and ethanol, and dried in a blast drying oven at 60° C. to obtain 1T/2H—$MoSe_2$—H/R—NiSe.

Figure 1:
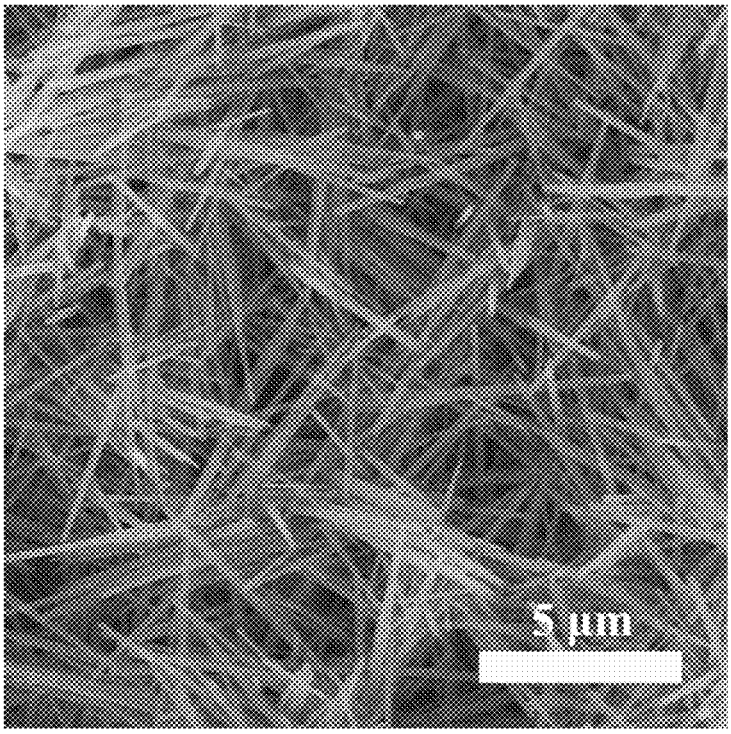
FIG. 1 shows a scanning electron microscopy (SEM) image of a $NiMoO_4$ precursor.

As shown in FIG. 1, the SEM image of $NiMoO_4$—NF shows that the as-prepared nanorods are distributed uniformly on the surface of NF.

Figure 2:
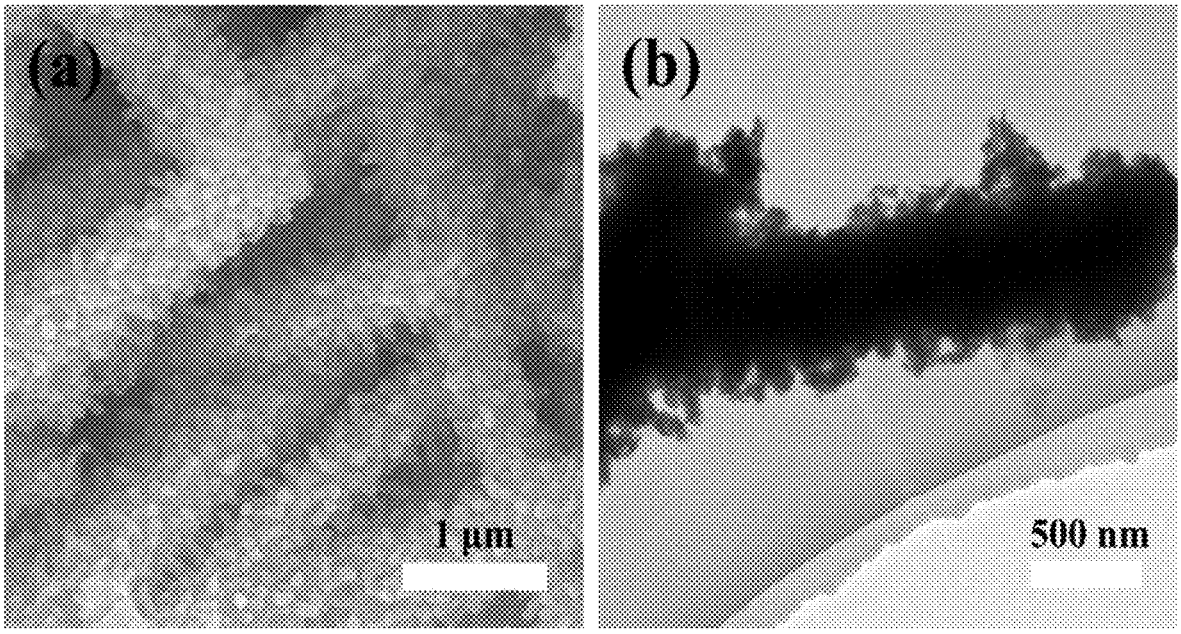
FIG. 2 shows an SEM image (a) and a transmission electron microscopy (TEM) image (b) of 1T/2H—$MoSe_2$—H/R—NiSe, where the scale is (a) 1 μm; and (b) 500 nm.

As shown in FIG. 2, 1T/2H—$MoSe_2$—H/R—NiSe maintains the morphology of nanorods, but the original smooth nanorod surface was decorated with nanosheets.

Figure 3:
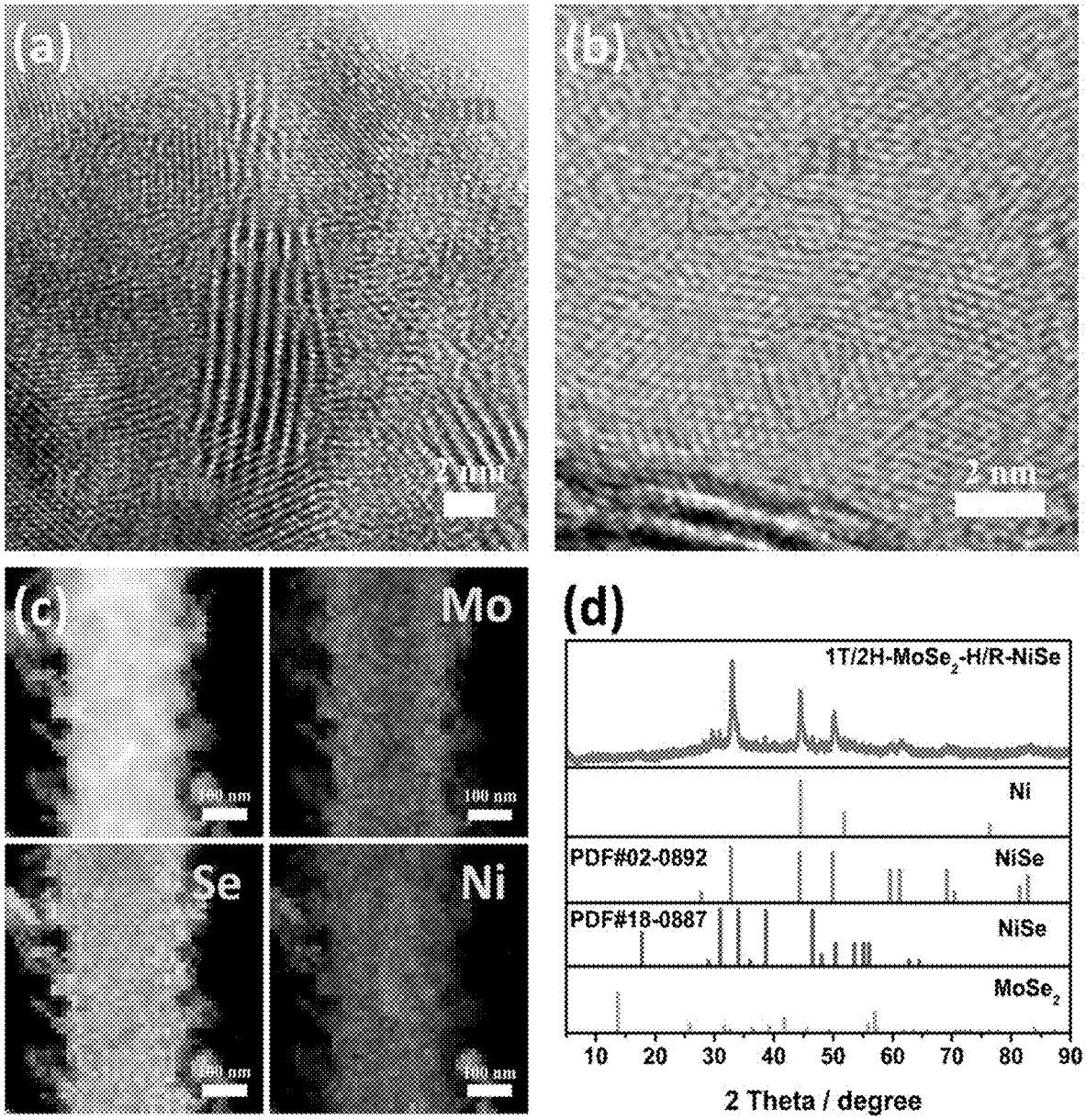
FIG. 3 shows a high-resolution TEM image (a, b), an energy dispersive X-ray (EDX)-Mapping spectrum (c) and a powder X-ray diffraction pattern (d) of 1T/2H—$MoSe_2$—H/R—NiSe.

As shown in FIG. 3, 1T/2H—$MoSe_2$—H/R—NiSe consists of 1T-$MoSe_2$, 2H—$MoSe_2$, H—NiSe, and R—NiSe, where Ni, Se, and Mo are uniformly distributed.

Figure 4:
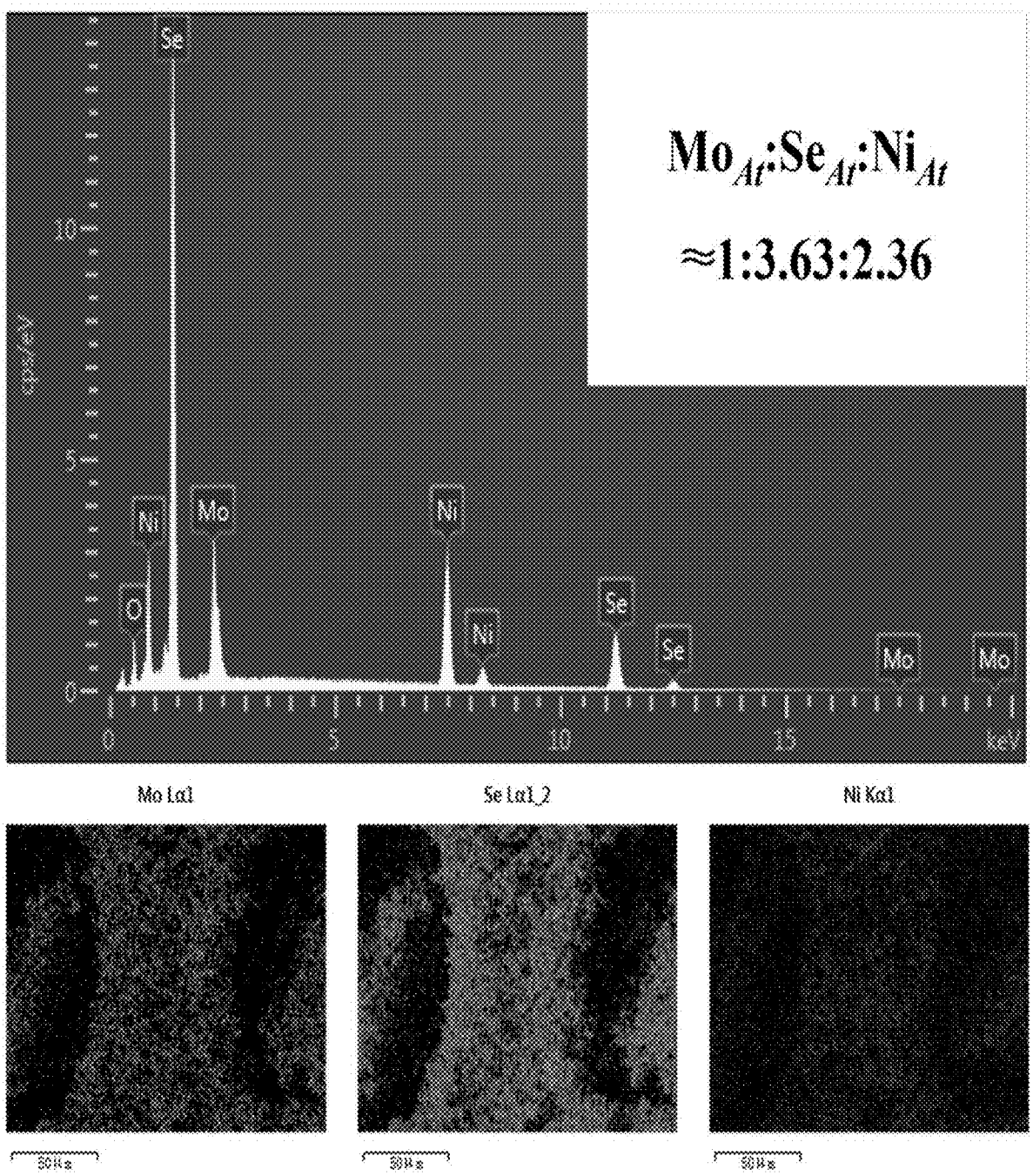
FIG. 4 shows an EDX spectrum of 1T/2H—$MoSe_2$—H/R—NiSe.

As shown in FIG. 4, the contents of Ni, Se, and Mo are generally consistent with the structure.

Figure 5:
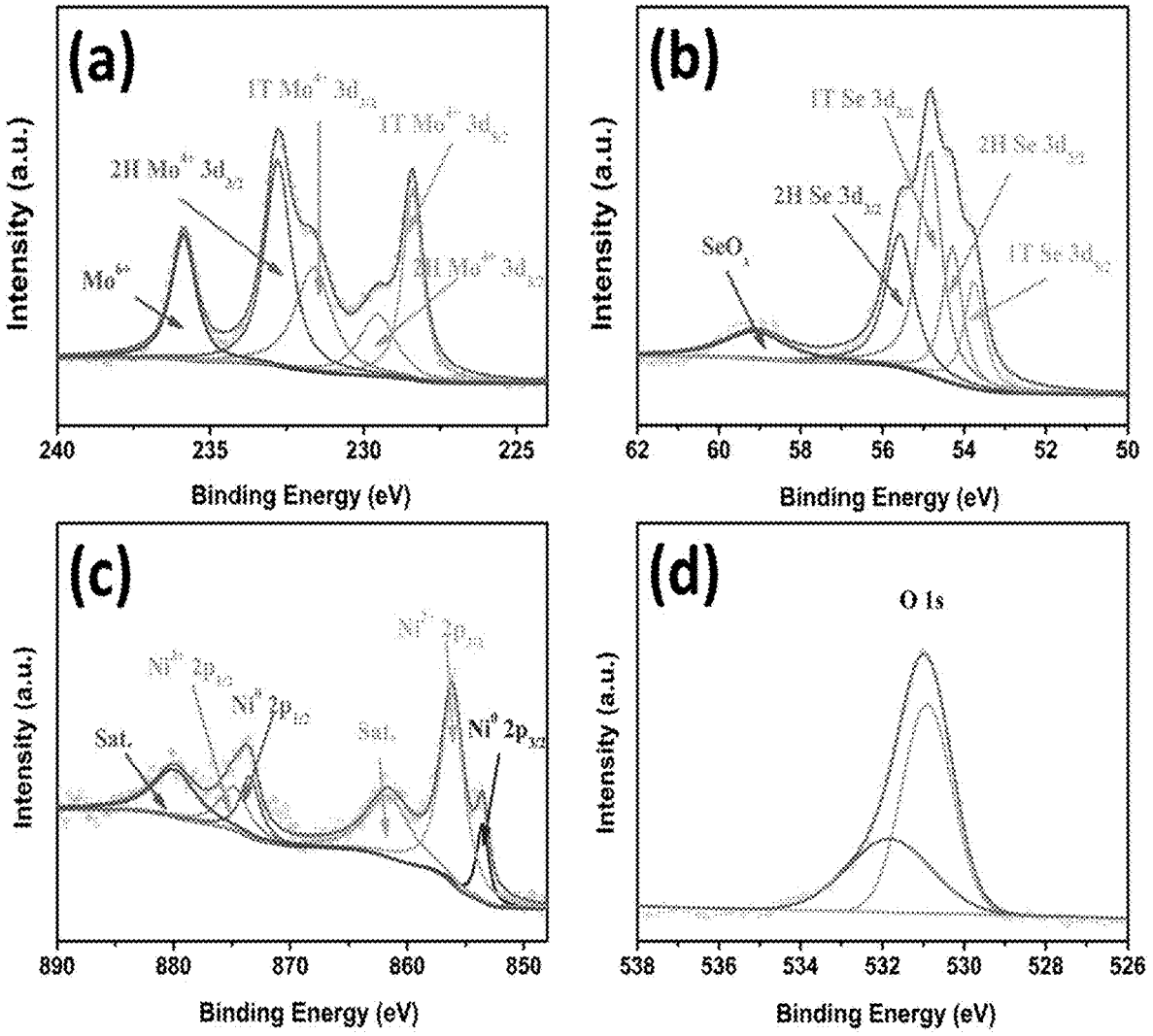
FIG. 5 shows an X-ray photoelectron spectroscopy (XPS) spectrum of 1T/2H—$MoSe_2$—H/R—NiSe.

As shown in FIG. 5, XPS spectrum of 1T/2H—$MoSe_2$—H/R—NiSe shows that the valence of Ni is +2, the valence of Mo is +4, and the valence of Se is −2, and XPS also suggests the co-existence of 1T-$MoSe_2$ and 2H—$MoSe_2$.

Example 2: Preparation of 1T/2H—$MoSe_2$—H—NiSe

⅔ mmol selenium powder was dissolved in 1.6 mL hydrazine hydrate solution, and then 8.4 mL deionized water containing ⅓ mmol sodium molybdate was added. The obtained solution was transferred into Teflon-lined stainless-steel autoclave and $NiMoO_4$—NF was added. The autoclave was sealed and maintained at 200° C. for 2 h. After cooling down to room temperature, the products were taken out and rinsed thoroughly with deionized water, ethanol and dried at 60° C. to obtain 1T/2H—$MoSe_2$—H—NiSe.

Figure 6:
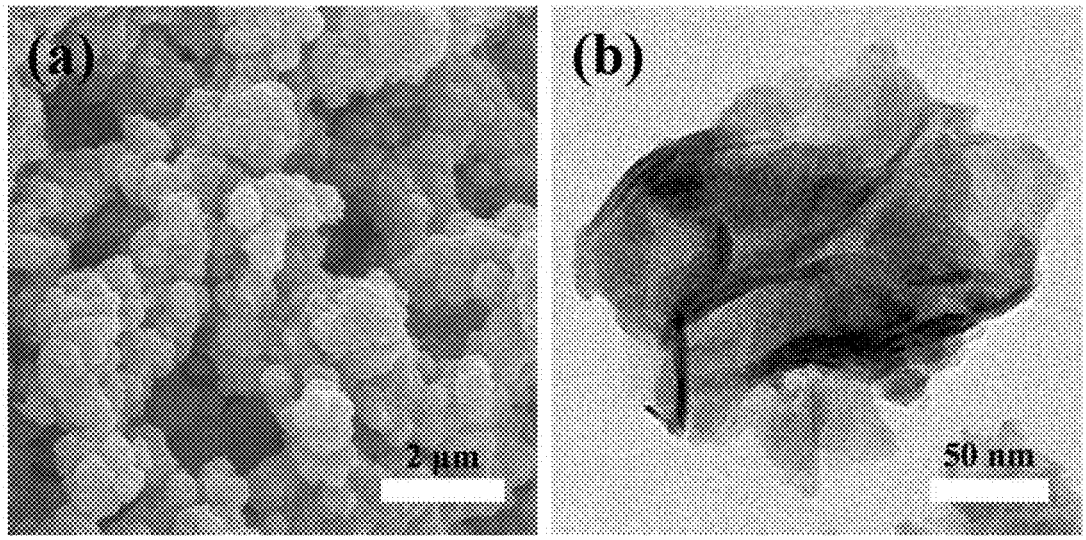
FIG. 6 shows an SEM image (a) and a TEM image (b) of 1T/2H—$MoSe_2$—H—NiSe where the scale is (a) 2 μm; and (b) 50 nm.

As shown in FIG. 6, the morphology of 1T/2H—$MoSe_2$—H—NiSe is not nanorods, but completely converted into nanosheets.

Figure 7:
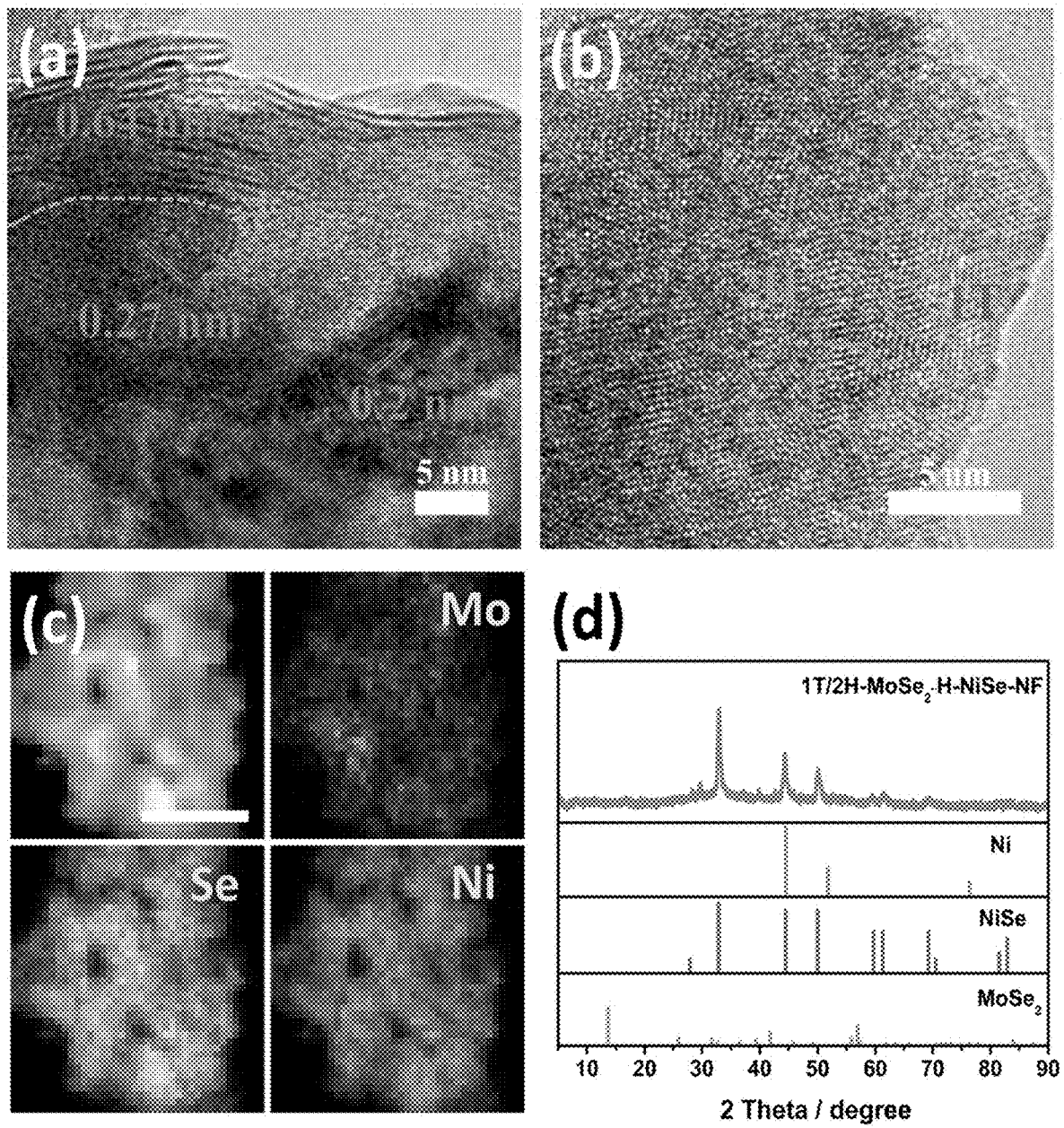
FIG. 7 shows a high-resolution TEM image (a, b), an EDX-Mapping spectrum (c) and a powder X-ray diffraction pattern (d) of 1T/2H—$MoSe_2$—H—NiSe.

As shown in FIG. 7, 1T/2H—$MoSe_2$—H—NiSe consists of 1T-$MoSe_2$, 2H—$MoSe_2$ and R—NiSe, where Ni, Se, and Mo are uniformly distributed.

Figure 8:
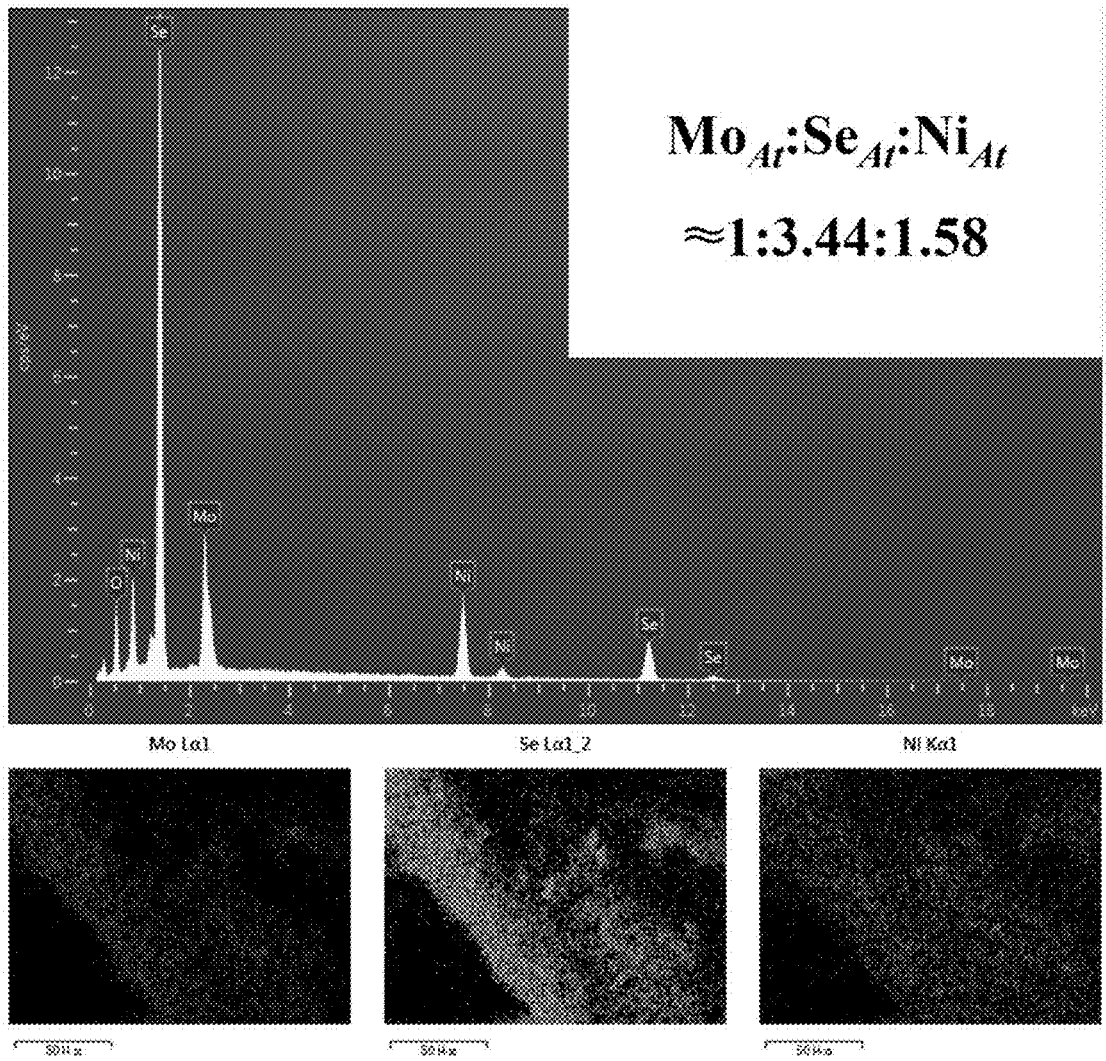
FIG. 8 shows an EDX spectrum of 1T/2H—$MoSe_2$—H—NiSe.

As shown in FIG. 8, the contents of Ni, Se, and Mo are generally consistent with the structure.

Figure 9:
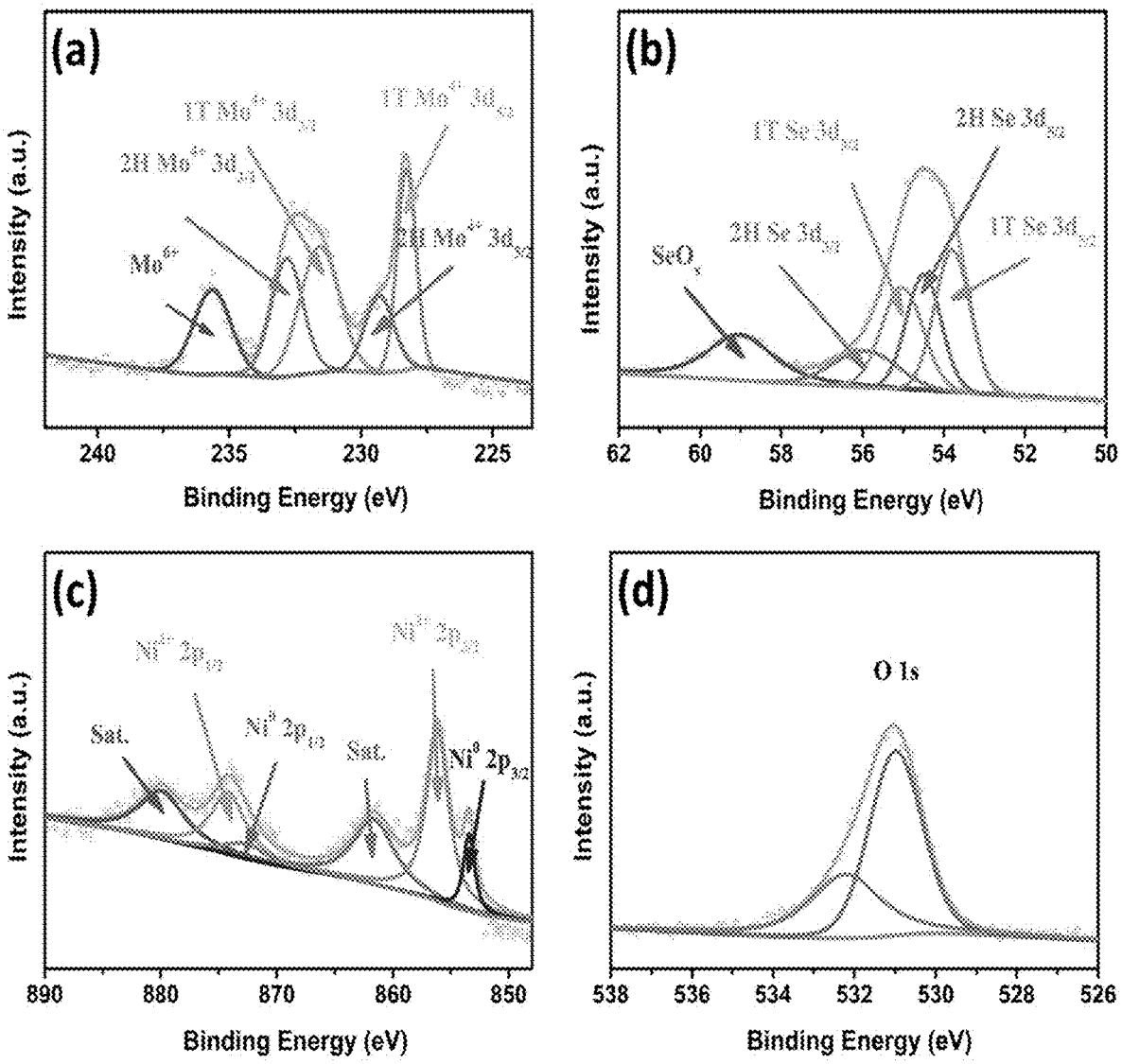
FIG. 9 shows an XPS spectrum of 1T/2H—$MoSe_2$—H—NiSe.

As shown in FIG. 9, XPS spectrum of 1T/2H—$MoSe_2$—H—NiSe shows that the valence of Ni is +2, the valence of Mo is +4, and the valence of Se is −2, and XPS also shows that $MoSe_2$ is composed of phases 1T and 2H in admixture.

Example 3: HER Performance in Alkaline Electrolyte

Electrochemical measurements were performed with a conventional three electrode arrangement consisting of 1T/2H—$MoSe_2$—H/R—NiSe—NF or 1T/2H—$MoSe_2$—H—NiSe—NF as working electrode (with an effective area of 0.5 $cm^2$), platinum foil as the counter electrode, and Ag/AgCl as reference electrode. Polarization curves were obtained using linear sweep voltammetry (LSV) with a scan rate of 5 mV $s^{-1}$ in 1 M KOH and the sweep range of the potential was −1.6 to −1 V. The HER was conducted without any iR drop compensation.

Figure 10:
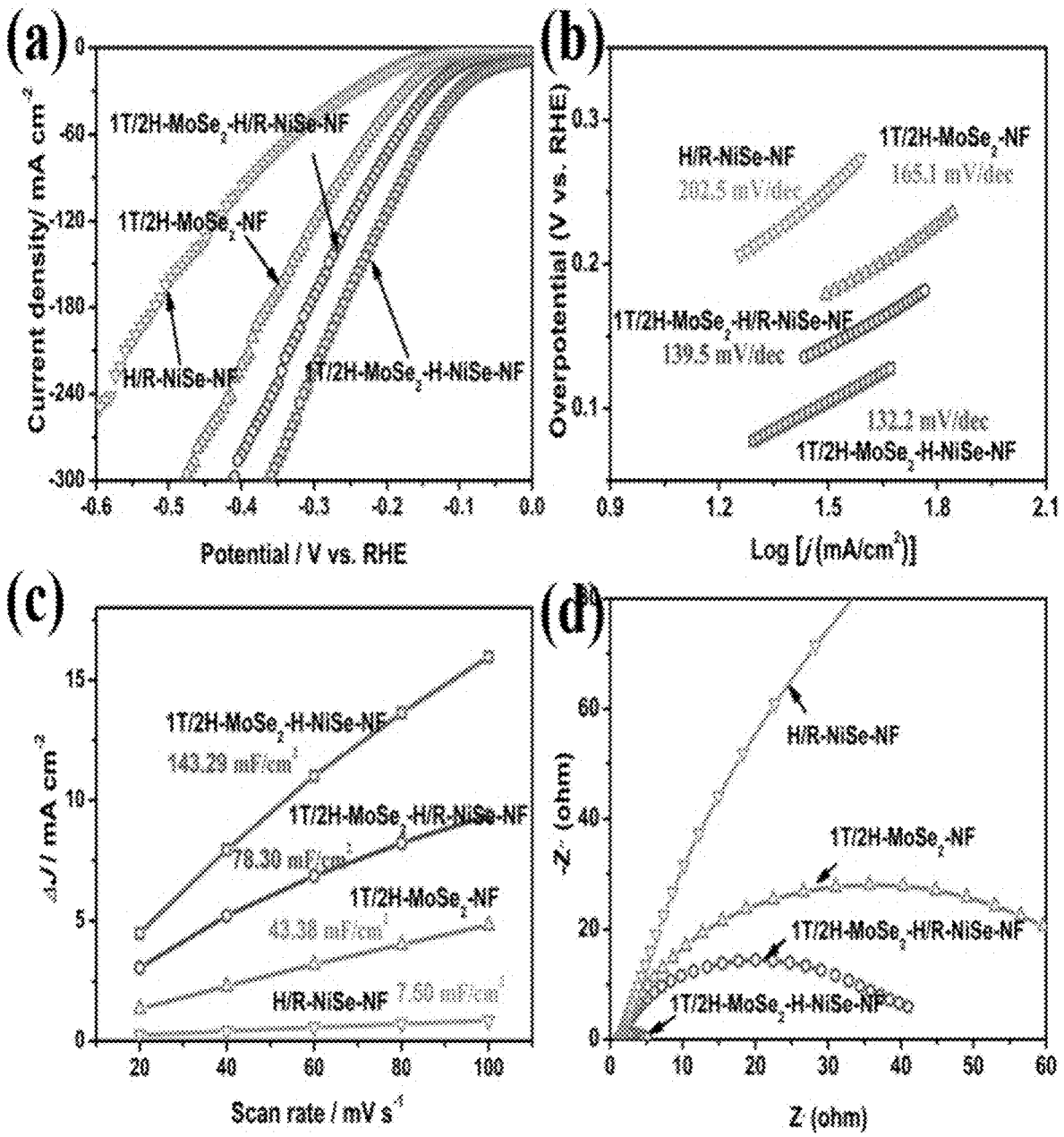
FIG. 10 shows a polarization curves (a), Tafel plots (b), double-layer capacitance curves (c), and a Nyquist plots (d) of 1T/2H—$MoSe_2$—NF, H/R—NiSe—NF, 1T/2H—$MoSe_2$—H/R—NiSe, and 1T/2H—$MoSe_2$—H—NiSe in HER in 1.0 M KOH.

As shown in FIGS. 10(*a*), and (*b*), 1T/2H—$MoSe_2$—H/R—NiSe—NF and 1T/2H—$MoSe_2$—H—NiSe—NF both exhibit excellent HER electrocatalytic performance, but 1T/2H—$MoSe_2$—H—NiSe—NF is better. At a current density of 10 mA·$cm^{-2}$, the overpotential is 87.6 mV and 30.6 mV, respectively, and the Tafel slope is 139.5 mV·$dec^{-1}$ and 132.2 mV·$dec^{-1}$ respectively. Compared with 1T/2H—$MoSe_2$—NF and H/R—NiSe—NF, the triphase and tetraphase heterojunction nanomaterials in this invention exhibit enhanced electrocatalytic performance.

Figure 11:
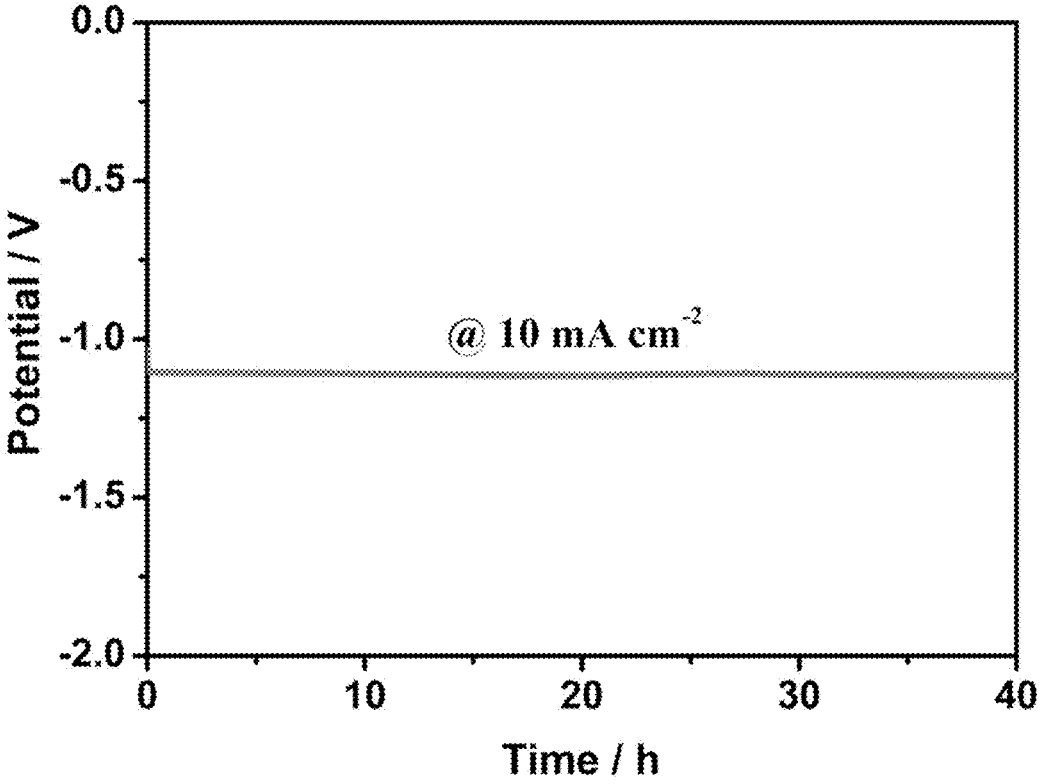
FIG. 11 is a chronopotentiometric curve of 1T/2H—$MoSe_2$—H—NiSe.

FIGS. 10(*c*) and (*d*) show that the excellent performance of 1T/2H—$MoSe_2$—H/R—NiSe—NF and 1T/2H—$MoSe_2$—H—NiSe—NF can be attributed to the large electrochemical active specific area and low charge transfer resistance. Besides, 1T/2H—$MoSe_2$—H—NiSe—NF shows excellent long-term durability with a negligible voltage change, even when operated for 40 h (FIG. 11).

In summary, the tetraphase 1T/2H—$MoSe_2$—H/R—NiSe and triphase 1T/2H—$MoSe_2$—H—NiSe heterojunction nanomaterials prepared in the present invention have large double-layer capacitance, large electrochemical active specific area and low charge transfer resistance, which enhanced the activity and stability for hydrogen production electrocatalysis in alkaline media.

The above-described embodiments are merely preferred embodiments for the purpose of fully illustrating the present invention, and the scope of the present invention is not limited thereto. Equivalent substitutions or modifications can be made by those skilled in the art based on the present invention, which are within the scope of the present invention as defined by the claims. The scope of the present invention is defined by the appended claims.

What is claimed is:

1. A method for preparing a multiphase heterojunction nanomaterial, consisting of steps of:

providing a substrate loaded with a $NiMoO_4$ precursor;

dissolving a selenium powder in hydrazine hydrate, adding water or sodium molybdate aqueous solution, then adding the substrate loaded with a $NiMoO_4$ precursor, and performing reaction at 180-200° C.; and obtaining the multiphase heterojunction nanomaterial after the reaction, wherein:

when water is added to hydrazine hydrate, the obtained multiphase heterojunction nanomaterial is a tetraphase heterojunction nanomaterial 1T/2H-$MoSe_2$—H/R—NiSe; and when sodium molybdate aqueous solution is added to hydrazine hydrate, the obtained multiphase heterojunction nanomaterial is a triphase heterojunction nanomaterial 1T/2H-$MoSe_2$—H—NiSe.

2. The method for preparing a multiphase heterojunction nanomaterial according to claim 1, wherein the substrate is nickel foam.

3. The method for preparing a multiphase heterojunction nanomaterial according to claim 1, wherein a volume ratio of hydrazine hydrate to water is 1-2:8-9.

4. The method for preparing a multiphase heterojunction nanomaterial according to claim 1, wherein a molar ratio of the selenium powder to sodium molybdate is 2:0.5-1.

5. The method for preparing a multiphase heterojunction nanomaterial according to claim 1, wherein the reaction time is 2-6 h.

6. The method for preparing a multiphase heterojunction nanomaterial according to claim 1, further comprising a step of washing and drying the obtained product, wherein the solvent for washing is deionized water and absolute ethanol.

7. The method for preparing a multiphase heterojunction nanomaterial according to claim 6, wherein the drying temperature is 40-60° C., and the drying time is 2-12 h.

* * * * *